US008668499B2

(12) United States Patent
Takahashi et al.

(10) Patent No.: US 8,668,499 B2
(45) Date of Patent: Mar. 11, 2014

(54) CONNECTOR

(75) Inventors: Koki Takahashi, Tokyo (JP); Koki Sato, Tokyo (JP); Mitsuru Kobayashi, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 51 days.

(21) Appl. No.: 13/365,613

(22) Filed: Feb. 3, 2012

(65) Prior Publication Data

US 2012/0231666 A1 Sep. 13, 2012

(30) Foreign Application Priority Data

Mar. 7, 2011 (JP) ..... 2011-049650

(51) Int. Cl.
*H01R 12/00* (2006.01)

(52) U.S. Cl.
USPC ..... 439/61

(58) Field of Classification Search
USPC ..... 439/81, 78, 62, 637
See application file for complete search history.

(56) References Cited

U.S. PATENT DOCUMENTS

| | | | | | |
|---|---|---|---|---|---|
| 4,478,471 | A | * | 10/1984 | Olsson | 439/267 |
| 4,550,959 | A | * | 11/1985 | Grabbe et al. | 439/33 |
| 4,634,198 | A | * | 1/1987 | Rush | 439/82 |
| 5,052,936 | A | * | 10/1991 | Biechler et al. | 439/60 |
| 5,759,048 | A | * | 6/1998 | Korsunsky et al. | 439/66 |
| 5,820,389 | A | * | 10/1998 | Hashiguchi | 439/66 |
| 6,042,386 | A | * | 3/2000 | Cohen et al. | 439/60 |
| 8,282,431 | B1 | * | 10/2012 | Zhang | 439/862 |

FOREIGN PATENT DOCUMENTS

JP 4280013 6/2009

* cited by examiner

*Primary Examiner* — Phuong Dinh
(74) *Attorney, Agent, or Firm* — IPUSA, PLLC

(57) ABSTRACT

A connector to be mounted on a substrate includes a first pad and a second pad formed on the surface, including a first contact including a first contacting portion to be in contact with the first pad when the connector is mounted on the substrate; and a second contact including a second contacting portion to be in contact with the second pad when the connector is mounted on the substrate, the first contact and the second contact being configured such that the first contacting portion slides on the first pad in a first direction while the second contacting portion slides on the second pad in a second direction opposite to the first direction, when the first contact and the second contact are pushed toward the first pad and the second pad, respectively, while the connector is being placed on and fixed to the substrate.

12 Claims, 8 Drawing Sheets

X-X
1
2
3
4b
4c
6
6a
X
P
1/2P
2a
3a
S1
S2
L1
L2
W1
W2

CONNECTOR

BACKGROUND OF THE INVENTION

1. Field of the Invention

The present invention relates to a connector and more specifically, to a connector used for electrically connecting a home, an office or an industrial electronic device and a substrate or substrates in an electronic device.

2. Description of the Related Art

When electrically and detachably connecting a substrate and an electronic device, or connecting substrates in an electronic device, a connector including a power source, a signal conductor, a ground conductor, a shield conductor or the like is generally used. Japanese Patent No. 4,280,013 discloses such a connector.

According to Japanese Patent No. 4,280,013, pads are aligned on a substrate to be connected and contacts are provided to correspond to the pads at a connector so that the contacts can respectively touch the pads when mounting the connector on the substrate.

The connector disclosed in Japanese Patent No. 4,280,013, is provided with two cylindrical protruding portions for temporal connection while a circular hole and an elliptical hole corresponding to the cylindrical protruding portions are provided at the surface of the substrate so that the connector can be temporarily connected to the substrate by inserting the cylindrical protruding portions of the connector into the circular hole and the elliptical hole of the substrate. After temporarily connecting the connector to the substrate by inserting the cylindrical protruding portions into the circular hole and the elliptical hole, the pads of the substrate and the contacts of the connector are respectively electrically connected by reflowing or soldering.

However, for the connector in which the contacts are electrically connected to the pads of the substrate by reflowing or soldering, the following problem occurs.

When disassembling the connector and the substrate after electrically connecting them by reflowing or soldering, it is necessary to melt the solder. Therefore, it is difficult to repair the connected structure by exchanging the connector with respect to the substrate.

Further, if the connector is connected and fixed to the substrate by screws, there may be a failure in electrical connection between the contacts and the pads as the pressure applied to the contacts and the pads is insufficient.

The result is that it becomes difficult to maintain the electrical connection between the connector and the substrate for which the repairing of the connected structure is possible.

Further, when connecting the contacts of the connector and the pads of the substrate by reflowing or soldering, a space for providing soldering paste is necessary above the contacts of the connector when the connector is placed on the substrate. For obtaining the space, the contacts of the connector may have an L shape and this may cause a large size of the structure especially when the connector includes plural lines of alignment of the contacts.

SUMMARY OF THE INVENTION

The present invention is made in light of the above problems, and provides a connector surely electrically connected to a substrate and capable of being repaired.

According to an embodiment, there is provided a connector to be mounted on a substrate including a first pad and a second pad formed on a surface of the substrate, including a first contact including a first contacting portion to be in contact with the first pad when the connector is mounted on the substrate; and a second contact including a second contacting portion to be in contact with the second pad when the connector is mounted on the substrate, the first contact and the second contact being configured such that the first contacting portion slides on the first pad in a first direction while the second contacting portion slides on the second pad in a second direction opposite to the first direction, when the first contact and the second contact are pushed toward the first pad and the second pad, respectively, while the connector is being placed on and fixed to the substrate.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
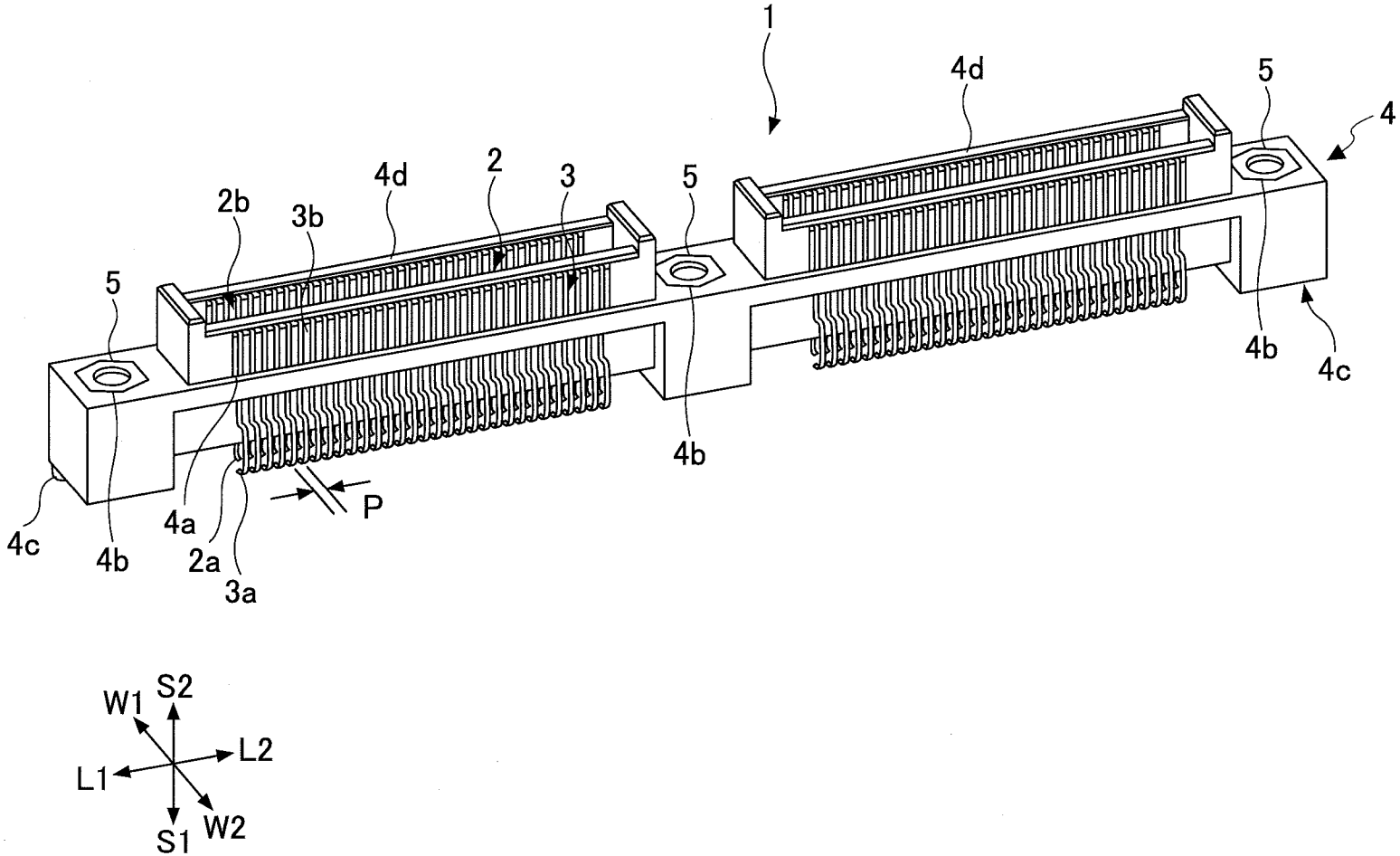
FIG. 1 is a perspective view showing an example of a connector of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

FIG. 1 is a perspective view showing an example of a connector 1 of the embodiment.

Hereinafter, the longitudinal direction of the connector 1 is referred to as a first alignment direction L1 and a second alignment direction L2, and the width direction of the connector 1 is referred to as a first width direction W1 and a second width direction W2. Further, the vertical downward direction in FIG. 1 is referred to as an approaching direction S1 and the vertical upward direction in FIG. 1 is referred to as an opposite direction S2.

Figures 2A, 2B, 2C:
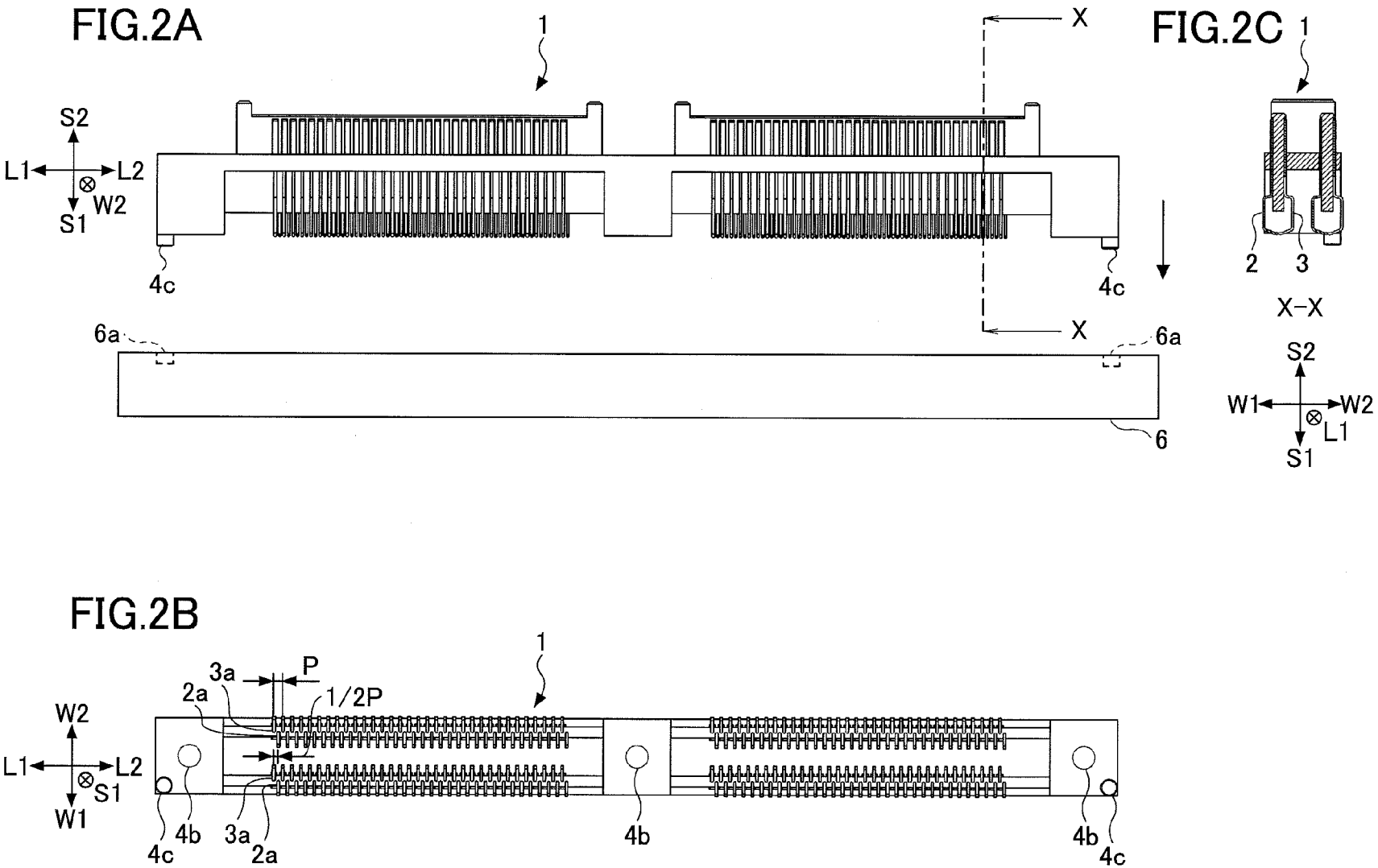
FIG. 2A is a side view of the connector shown in FIG. 1.
FIG. 2B is a bottom view of the connector shown in FIG. 1.
FIG. 2C is a cross-sectional view of the connector taken along an X-X line of FIG. 2A.

FIG. 2A is a side view of the connector 1 seen from the second width direction W2 side in FIG. 1. FIG. 2B is a bottom view of the connector 1 seen from the approaching direction S1 side in FIG. 1. FIG. 2C is a cross-sectional view of the connector 1 taken along an X-X line of FIG. 2A.

Figure 3:
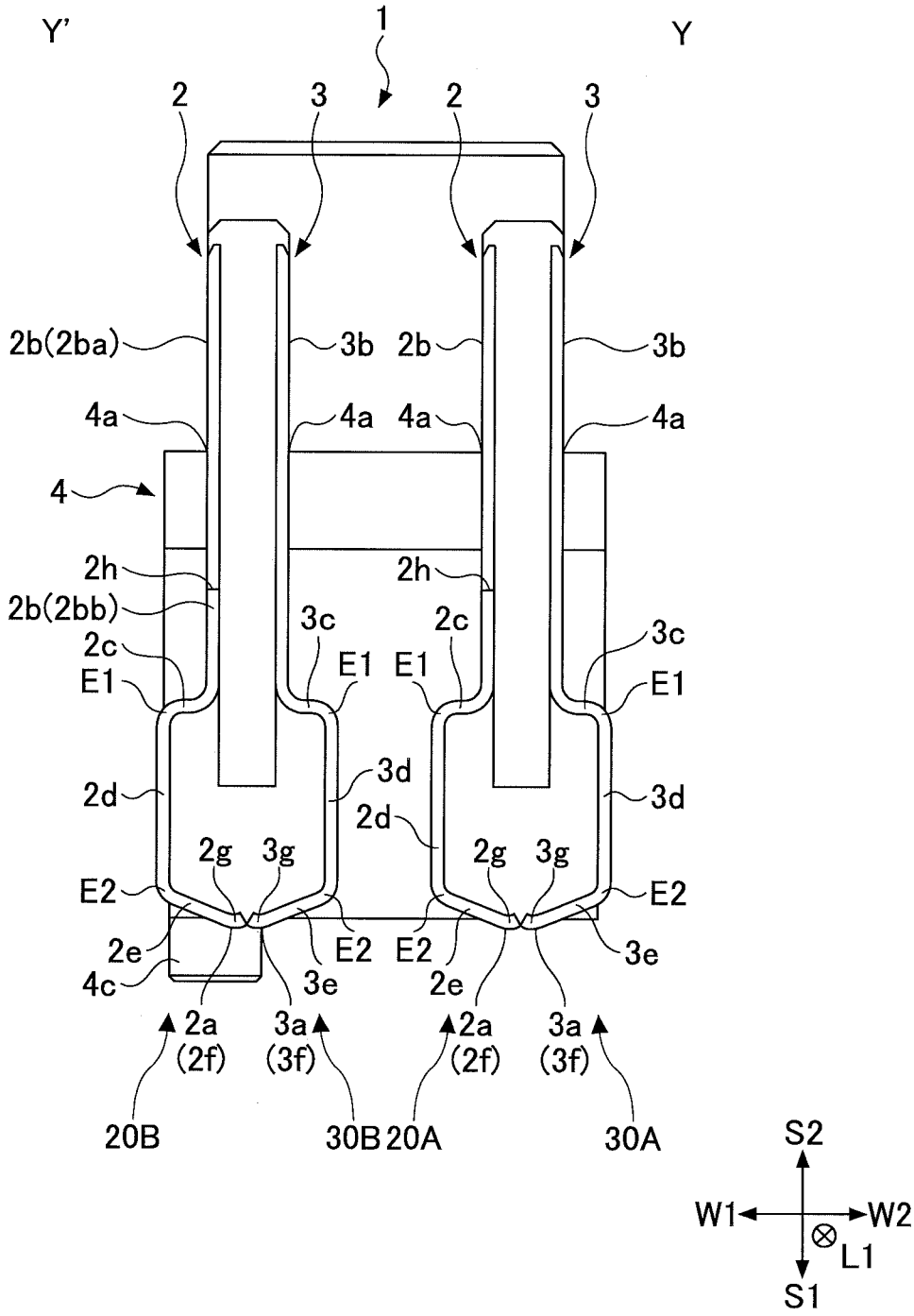
FIG. 3 is an enlarged cross-sectional view of the connector taken along the X-X line of FIG. 2A.

FIG. 3 is an enlarged cross-sectional view of the connector 1 taken along the X-X line of FIG. 2A. FIG. 3 corresponds to an enlarged view of FIG. 2C.

As shown in FIG. 2A or FIG. 3, the connector 1 is intended to be mounted on a substrate 6 including first pads and second pads (not shown in the drawings; hereinafter, the first pads and the second pads may be simply referred to as pads as well) formed or the substrate. When mounting the connector 1 on the substrate 6, the connector 1 is moved in the approaching direction S1 with respect to the substrate 6.

The connector 1 includes plural first contacts 2, plural second contacts 3, a housing 4 and fixing members. The plural first contacts 2 and the plural second contacts 3 are formed to correspond to the first pads and the second pads (not shown in the drawings) of the substrate 6, respectively.

In this embodiment, the plural first contacts 2 are aligned in the first alignment direction L1 and the second alignment direction L2 (third direction) with a predetermined pitch P. Similarly, the plural second contacts 3 are aligned in the parallel relationship with the plural first contacts 2 in the first alignment direction L1 and the second alignment direction L2 with the predetermined pitch P.

The connector 1 of the embodiment includes two lines of alignment of the first contacts 2 and two lines of alignment of the second contacts 3 alternately positioned in the first width direction W1 and the second width direction W2.

The housing 4 is provided with plural holes 4*a* corresponding to the plural first contacts 2 and the plural second contacts 3, three inserting portions 4*b* in which three screws 5 as the fixing members are respectively inserted, two guide portions 4*c* for an alignment and two opening portions 4*d*.

The inserting portions 4*b* are respectively provided at the ends and the center between the opening portions 4*d* of the housing 4 in the first alignment direction L1 and the second alignment direction L2. The cylindrical guide portions 4*c* are provided at the furthest ends of the housing 4 in the first alignment direction L1 and the second alignment direction L2.

The lines of alignment of the first contacts 2 and the second contacts 3 are divided into two parts in the first alignment direction L1 and the second alignment direction L2 to be exposed in the respective opening portions 4*d* of the housing 4.

The substrate 6 is provided with two guide holes 6*a* (see FIG. 2A) provided at the ends of the substrate 6 in the first alignment direction L1 and the second alignment direction L2 to correspond to the guide portions 4*c* of the connector 1. Although not shown in the drawings, the substrate 6 is further provided with fixing members such as threaded holes or the like at the surface for receiving the respective screws 5 of the connector 1.

When mounting the connector 1 on the substrate 6, the guide portions 4*c* of the connector 1 are inserted in the guide holes 6*a* of the substrate 6 for an alignment and then the screws 5 of the connector 1 are connected with the fixing members such as the threaded holes of the substrate 6.

The structures of the first contacts 2 and the second contacts 3 will now be explained in detail.

As shown in FIG. 3, each of the first contacts 2 includes a first contacting portion 2*a*, a base portion 2*b*, a curving portion 2*c*, an elongating portion 2*d*, a bent portion 2*e* and an offset portion 2*h*.

The base portion 2*b* is positioned at the opposite direction S2 side of the contact 2. For the first contact 2, the base portion 2*b* is composed of a first base portion 2*ba* and a second base portion 2*bb*. The first base portion 2*ba* and the second base portion 2*bb* extend in the approaching direction S1. The first base portion 2*ba* and the second base portion 2*bb* are connected via the offset portion 2*h*. The structure of the offset portion 2*h* will be explained later in detail.

The curving portion 2*c* extends from the end of the second base portion 2*bb* of the base portion 2*b* to be curved or bent in the first width direction W1 (first direction). The elongating portion 2*d* extends from the end E1 of the curving portion 2*c* in the approaching direction S1.

The bent portion 2*e* extends from the end E2 of the elongating portion 2*d* in the second width direction W2 while being inclined toward the approaching direction S1.

The bent portion 2*e* of the first contact 2 includes an outer surface portion 2*f* which is at the lowest position (the approaching direction S1 side) of the first contact 2 and an inner edge portion 2*g* which is at the edge of the first contact 2. The outer surface portion 2*f* of the first contact 2 is the first contacting portion 2*a* to be in contact with the first pad of the substrate 6 when the connector 1 is mounted on the substrate 6.

Similarly, each of the second contacts 3 includes a second contacting portion 3*a*, a base portion 3*b*, a curving portion 3*c*, an elongating portion 3*d* and a bent portion 3*e*.

The second contact 3 does not include the offset portion. The base portion 3*b* of the second contact 3 extends in the approaching direction S1.

The curving portion 3*c* extends from the end of the base portion 3*b* to be curved or bent in the second width direction W2 (second direction).

The bent portion 3*e* extends from the end E2 of the elongating portion 3*d* in the first width direction W1 while being inclined toward the approaching direction S1.

The bent portion 3*e* of the second contact 3 includes an outer surface portion 3*f* which is at the lowest position (the approaching direction S1 side) of the second contact 3 and an inner edge portion 3*g* which is at the edge of the second contact 3. The outer surface portion 3*f* of the second contact 3 is a second contacting portion 3*a* to be in contact with the second pad of the substrate 6 when the connector 1 is mounted on the substrate 6.

Concretely, the first contact 2 is configured to be smoothly curved or bent at the end of the second base portion 2*bb*, smoothly curved or bent at the end E1 of the curving portion 2*c* and then bent at the end E2 of the elongating portion 2*d*. The first contact has a shape where the curving portion 2*c*, the elongating portion 2*d*, and a part of the bent portion 2*e* are formed to protrude in the first width direction W1 relative to a line extending from the base portion 2*b*. The inner edge portion 2*g* is positioned at the second width direction W2 side of the outer surface portion 2*f*.

Similarly, the second contact 3 is configured to be smoothly curved or bent at the end of the base portion 3*b*, smoothly curved or bent at the end E1 of the curving portion 3*c* and then bent at the end E2 of the elongating portion 3*d*. The second contact has a shape where the curving portion 3*c*, the elongating portion 3*d*, and a part of the bent portion 3*e* are formed to protrude in the second width direction W2 relative to a line extending from the base portion 3*b*. The inner edge portion 3*g* is positioned at the first width direction W1 side of the outer surface portion 3*f*.

In this embodiment, the first contacts 2 and the second contacts 3 are configured such that the first contacting portion 2*a* slides on the first pad of the substrate 6 in the first width direction W1 while the second contacting portion 3*a* slides on the second pad of the substrate 6 in the second width direction W2 opposite to the first width direction W1, when the first contact 2 and the second contact 3 are pushed toward the first pad and the second pad of the substrate 6, respectively, while the connector 1 is being placed on and fixed to the substrate 6.

Further, the base portion 2*b* (first base portion 2*ba*) of the first contact 2 and the base portion 3*b* of the second contact 3 are held by the housing 4 to not slide even when the first contact 2 and the second contact 3 are pushed toward the first pad and the second pad of the substrate 6, respectively.

Further, the first contact 2 includes an elastic portion that slides the first contacting portion 2*a* in the first width direction W1 when the first contact 2 is pushed toward the first pad of the substrate 6. The curving portion 2*c*, the elongating portion 2*d*, and the bent portion 2*e* compose the elastic portion of the first contact 2.

The second contact 3 includes an elastic portion that slides the second contacting portion 3*a* in the second width direction W2 when the second contact 3 is pushed toward the second pad of the substrate. The curving portion 3*c*, the elongating portion 3*d*, and the bent portion 3*e* compose the elastic portion of the second contact 3.

As shown in FIG. 3, in this embodiment, one of the lines (first line) of alignment of the first contacts 2 and one of the lines (second line) of alignment of the second contacts 3 are aligned to face each other such that the curving portions 2*c* and the corresponding curving portions 3*c* separate from each other while the first base portions 2*ba* of the first contacts 2 and the corresponding base portions 3*b* of the second contacts 3 face each other.

The outer surface portion 2*f* is positioned at the second width direction W2 side of its end E1. Similarly, the outer surface portion 3*f* is positioned at the first width direction W1 side of its end E1. Therefore, the outer surface portion 2*f* and the outer surface portion 3*f* are positioned between or inside of the ends E1 of the first contact 2 and the second contact 3.

As shown in FIG. 1, the base portions 2*b* of the first contacts 2 and the base portions 3*b* of the second contacts 3 are held in the holes 4*a* of the housing 4 while the parts of the first contacts 2 and the second contacts 3, except for the upper parts of the base portions 2*b* and the base portions 3*b*, are exposed from the housing 4 toward the approaching direction S1.

The opening portions 4*d* of the housing 4 of the embodiment are provided to penetrate the housing in the approaching direction S1 and the opposite direction S2 with square shapes. The base portions 2*b* of the first contacts 2 and the base portions 3*b* of the second contacts 3 are exposed at the inner side walls of the opening portions 4*d*.

Another external connector including plural contacts, not shown in the drawings, may be detachably attached to the opening portions 4*d* so that the contacts of the external connector are electrically connected with the corresponding contacts 2 and the contacts 3.

Figure 6A:
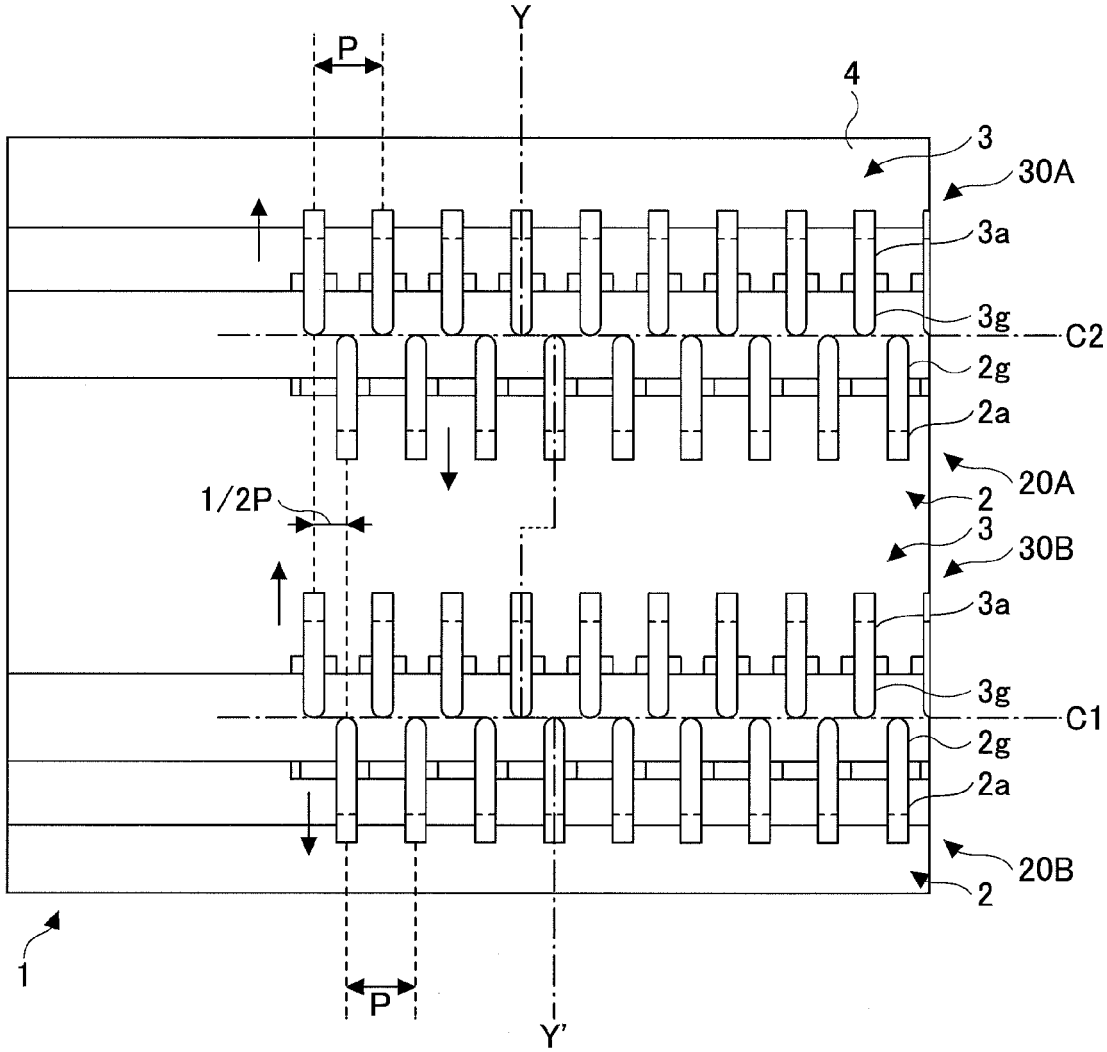
FIG. 6A is an enlarged bottom view of the connector shown in FIG. 1.

Next, an alignment of the contacts 2 and the contacts 3 is explained. FIG. 6A is an enlarged bottom view of the connector 1 seen from the approaching direction S1 side in FIG. 1. FIG. 6A corresponds to an enlarged view of FIG. 2B.

The lines of alignment of the first contacting portions 2*a* are expressed as lines 20A and 20B (second line and fourth line), and the lines of alignment of the second contacting portions 3*a* are expressed as lines 30A and 30B (first line and third line) for explanation.

In this embodiment, the first contacts 2 in the line 20A and the second contacts 3 in the line 30A, and the first contacts 2 in the line 20B and the second contacts 3 in the line 30B are respectively aligned to face each other (see FIG. 3).

The first contacts 2 of the line 20A and the second contacts 3 of the line 30A are positioned close to each other. Similarly, the first contacts 2 of the line 20B and the second contacts 3 of the line 30B are positioned close to each other.

The inner edge portions 2*g* of the first contacts 2 of the line 20A and the inner edge portions 3*g* of the second contacts 3 of the line 30A are on the center line C2, and the inner edge portions 2*g* of the first contacts 2 of the line 20B and the inner edge portions 3*g* of the second contacts 3 of the line 30B are on the center line C1.

The line 20A of alignment of the first contacting portions 2*a* of the first contacts 2 is shifted a predetermined amount with respect to the line 30A of alignment of the second contacting portion 3*a* of the second contacts 3, in the first alignment direction L1 and the second alignment direction L2. The predetermined amount may be less than a predetermined pitch P. In this embodiment, the predetermined amount is ½P (half of the pitch P).

Similarly, the line 20B of alignment of the first contacting portions 2*a* of the first contacts 2 is shifted the predetermined amount, which is ½P in this embodiment, with respect to the line 30B of alignment of the second contacting portion 3*a* of the second contacts 3, in the first alignment direction L1 and the second alignment direction L2.

Further in this embodiment, the line 20A of alignment of the first contacting portions 2*a* of the first contacts 2 is shifted the predetermined amount, which is ½P in this embodiment, with respect to the line 30B of alignment of the second contacting portions 3*a* of the second contacts 3, in the first alignment direction L1 and the second alignment direction L2.

In other words, the first contacting portions 2*a* and the second contacting portions 3*s* are aligned in a zigzag shape, where the first contacting portion 2*a* and the second contacting portion 3*a* are not aligned on a line extending in the first width direction W1 and the second width direction W2. Although not shown in the drawings, the first pads and the second pads of the substrate 6 are formed in the zigzag shape corresponding to the alignment of the first contacting portions 2*a* and the second contacting portions 3*a* of the connector 1. In this embodiment, the first base portions 2*ba* of the first contacts 2 and the base portions 3*b* of the second contacts 3 are aligned on a line extending in the first width direction W1 and the second width direction W2 and a line extending in the first alignment direction L1 and the second alignment direction L2.

In this embodiment, each of the first contacts 2 is provided to include the offset portion 2*h* that offsets (or shifts) the lower part of the first contact 2 such as the second base portion 2*bb*, the curving portion 2*c*, the elongating portion 2*d* and the bent portion 2*e* (the first contacting portion 2*a*) for ½P (half of the pitch P) with respect to the upper part of the first contact 2 such as the first base portion 2*ba*.

Figure 7:
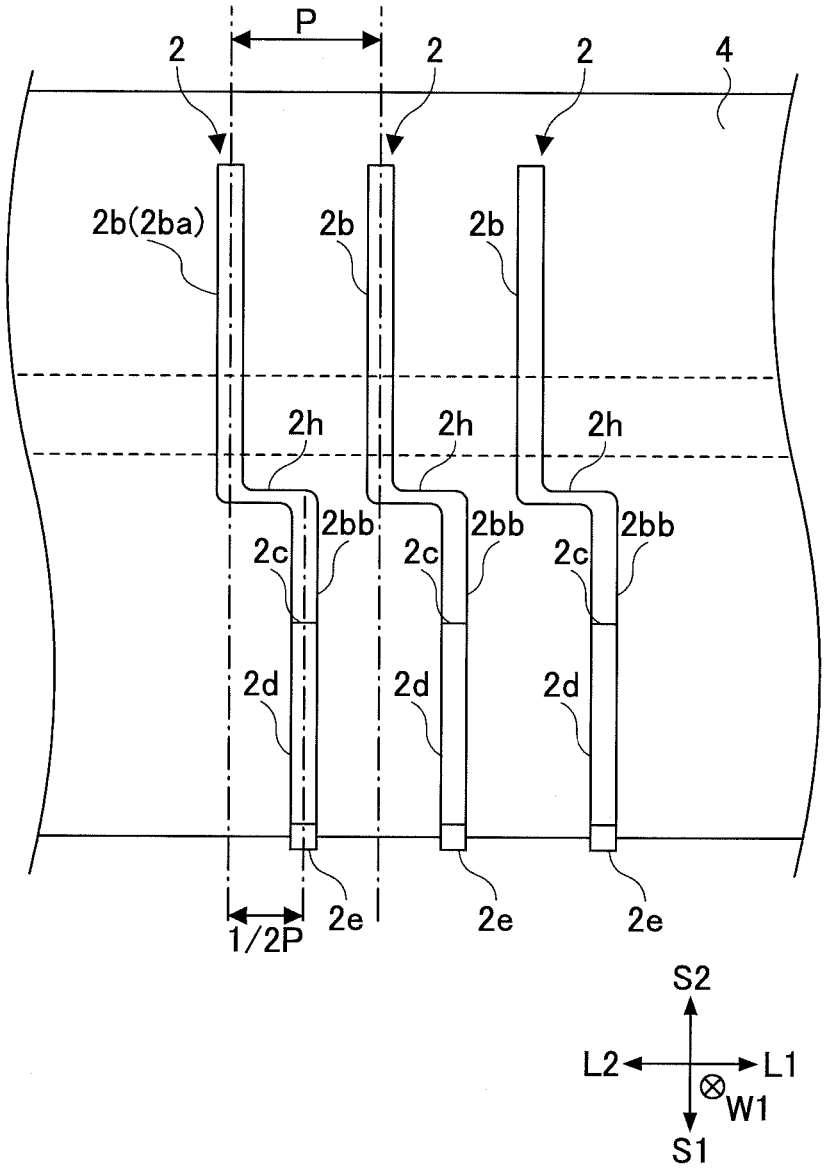
FIG. 7 is a side view showing a part of the connector shown in FIG. 3.

FIG. 7 is a side view showing a part of the connector 1 seen from the first width direction W1 side in FIG. 3. A part of the housing 4 that covers a part of the first contacts 2 and the second contacts 3 is shown as dotted lines for explanation. The offset portion 2*h* is provided between the first base portion 2*ba* and the second base portion 2*bb*.

Therefore, in this embodiment, the first base portions 2*ba* of the first contacts 2 of the line 20A face the respective base portions 3*b* of the second contacts 3 of the line 30A, while the first contacting portions 2*a* of the first contacts 2 of the line 20A are shifted ½P relative to the respective second contacting portions 3*a* of the second contacts 3 of the line 30A, for example. Actually, FIG. 3 corresponds to a cross-sectional view of a Y-Y' line of FIG. 6A (although the first base portion 2*ba* of the first contact 2 is positioned on the same line as the second contacting portion 3*a* of the second contact 3).

Referring to FIG. 1, the housing 4 is composed of an insulator having appropriate properties. The housing 4 holds the base portions 2*b* of the contacts 2 and the base portions 3*b* of the contacts 3.

The contacts 2 and the contacts 3 may be composed of a conductive and elastic material such as a copper alloy or the like having conductivity and elasticity. The contacts 2 and the contacts 3 may be formed by pressing, bending or the like. The surfaces of the first contacting portions 2*a* of the first contacts 2 and the second contacting portions 3*a* of the second contacts 3 may be appropriately plated if necessary.

The pads (not shown in the drawings) of the substrate 6 may be appropriately plated if necessary.

The operation of mounting the connector 1 on the substrate 6 is explained.

As shown in FIG. 2A, when mounting the connector 1 on the substrate 6, the substrate 6 is positioned at the approaching direction S1 side (lower side) of the connector 1.

Then, the connector 1 is placed on the substrate 6 while inserting the guide portions 4*c* of the housing 4 in the guide holes 6*a* of the substrate 6. This state is referred to as an initial placing position hereinafter.

Thereafter, the fixing members (not shown in the drawings) of the substrate 6 are fixed with the screws 5 of the connector 1. With this operation, the connector 1 is fixed to the substrate 6. This state is referred to as a final mounting position hereinafter.

Figure 5C:
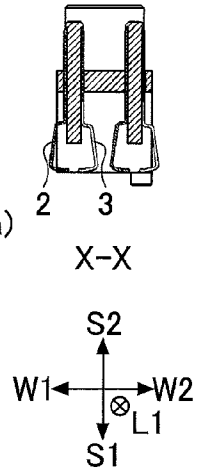
FIG. 5C is a cross-sectional view of the connector taken along an X-X line of FIG. 5A.
Figure 5A:
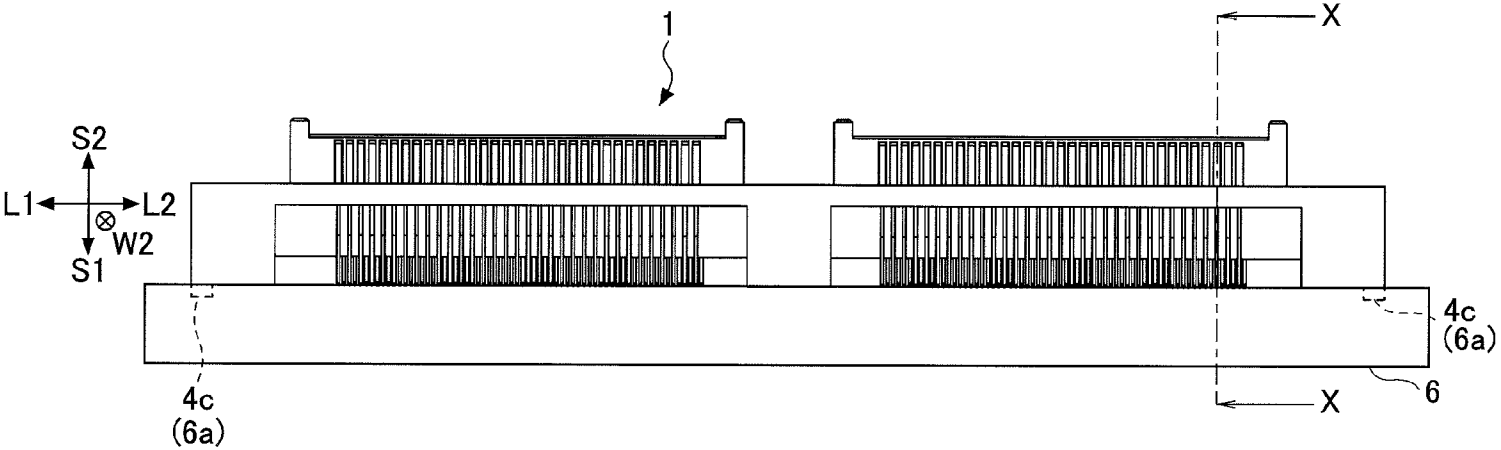
FIG. 5A is a side view of the connector shown in FIG. 1 when the connector is mounted on the substrate.
Figure 5B:
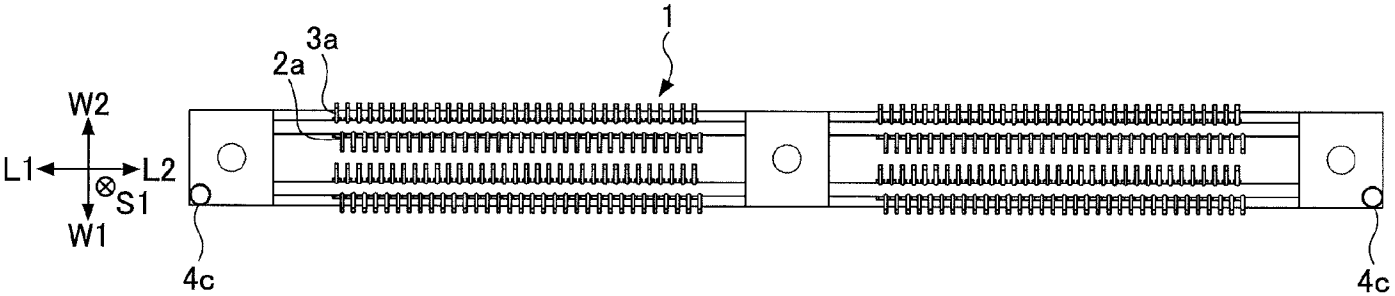
FIG. 5B is a bottom view of the connector shown in Fig. when the connector is mounted on the substrate.

FIG. 5A is a side view of the connector 1 seen from the second width direction W2 in FIG. 1 at the final mounting position. FIG. 5B is a bottom view of the connector 1 seen from the approaching direction S1 in FIG. 1 at the final mounting position. FIG. 5C is a cross-sectional view of the connector 1 taken along an X-X line of FIG. 5A. FIG. 5A, FIG. 5B and FIG. 5C show the status at the final mounting position and respectively correspond to FIG. 2A, FIG. 2B and FIG. 2C.

According to this embodiment, while the fixing members (not shown in the drawings) of the substrate 6 are being fixed with the respective screws 5 of the connector 1, a fixing force that pushes the connector 1 toward the substrate 6 (in the approaching direction S1) is generated by the screws 5 and the fixing members of the substrate 6.

Then, the fixing force is applied to the contacting surfaces between the first contacting portions 2*a* of the first contacts 2 and the second contacting portions 3*a* of the second contacts 3 of the connector 1 and the pads of the substrate 6 in the approaching direction S1 and the opposite direction S2. When the fixing force is applied to the first contacting portions 2*a* and the second contacting portions 3*a*, each of the first contacts 2 and the second contacts 3 slightly deflects in the opposing direction S2 and stores an elastic force at the corresponding elastic portion.

By the stored elastic force, as the first contact 2 includes the curving portion 2*c* that extends in the first width direction W1, a moment is applied to the first contacting portion 2*a*, which is rotated in the clockwise direction around the end of the second base portion 2*bb* as a center.

Similarly, by the stored elastic force, as the second contact 3 includes the curving portion 3*c* that extends in the second width direction W2, a moment is applied to the second contacting portion 3*a*, which is rotated in the counterclockwise direction around the end of the base portion 3*b* as a center.

As the curving portion 2*c* of the first contact 2 and the curving portion 3*c* of the second contact 3 are formed to smoothly curve, the stored elastic forces are maintained at the curved portions, respectively. The first contact 2 and the second contact 3 may be composed of a material or may be formed in a shape such that the first contact 2 and the second contact 3 reversibly deflect even when the fixing force is applied to them.

Figure 4:
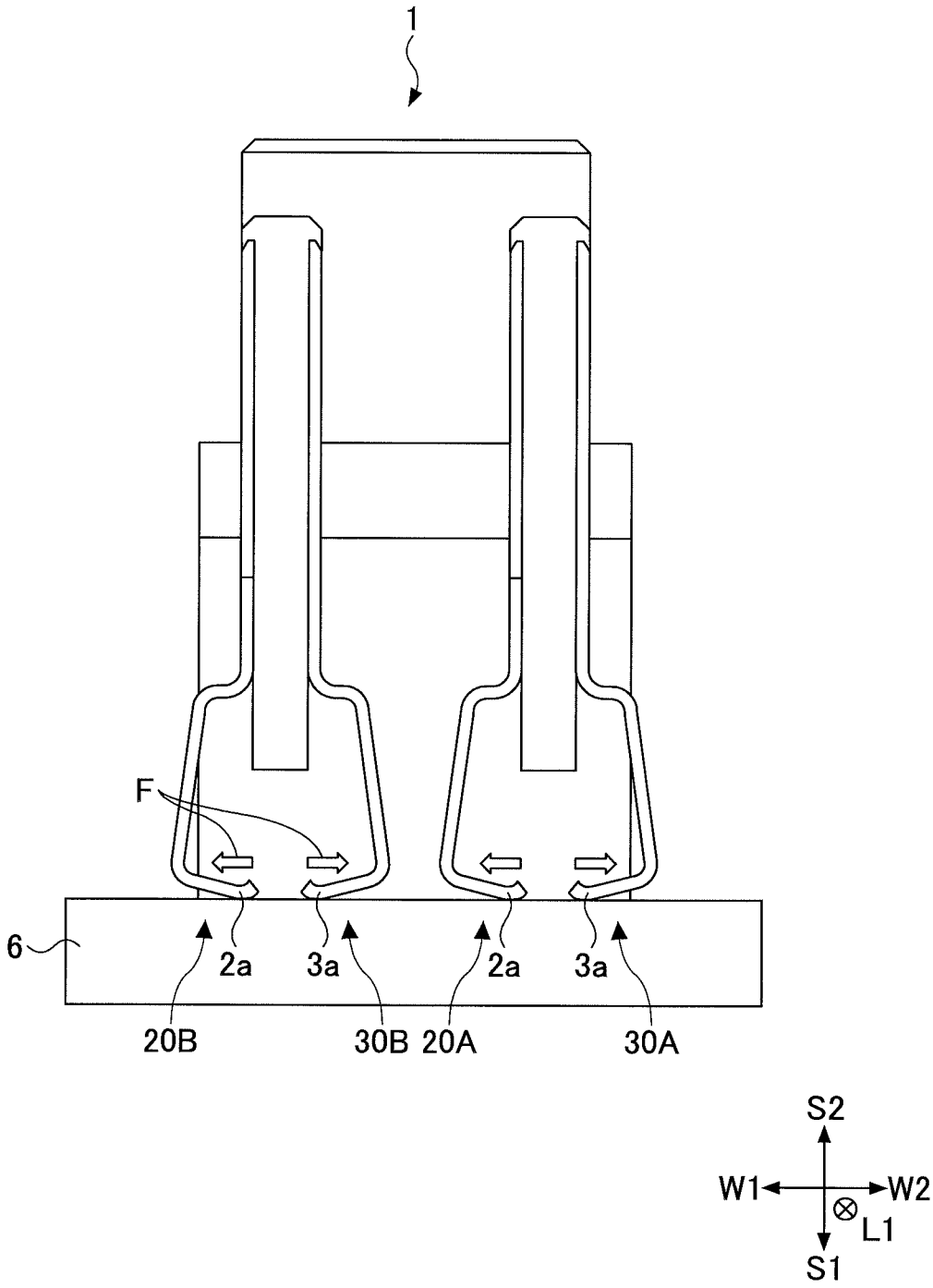
FIG. 4 is an enlarged cross-sectional view of the connector when the connector is mounted on a substrate.

When gradually fixing the screws 5 of the connector 1 to the fixing members of the substrate 6, for mounting the connector 1 on the substrate 6, friction forces are generated between the first contacting portions 2*a* and the respective pads of the substrate 6, and the second contacting portions 3*a* and the respective pads of the substrate 6. When the fixing force applied to each of the first contacting portions 2*a* and the second contacting portion 3*a* becomes larger and the resulting moment overcomes the friction force applied to the corresponding first contacting portions 2*a* and the second contacting portion 3*a*, the first contacting portions 2*a* and the second contacting portions 3*a* slide on the surface of the corresponding pads in the directions as shown by arrows F in FIG. 4. FIG. 4 is an enlarged cross-sectional view of the connector 1 taken along the X-X line of FIG. 5A. FIG. 4 corresponds to FIG. 3.

In this embodiment, the first contacting portions 2*a* of the first contacts 2 of the line 20B and the second contacting portions 3*a* of the second contacts 3 of the line 30B slide in directions opposite from each other. Similarly, the first contacting portions 2*a* of the first contacts 2 of the line 20A and the second contacting portions 3*a* of the second contacts 3 of the line 30A slide in directions opposite from each other.

Figure 6B:
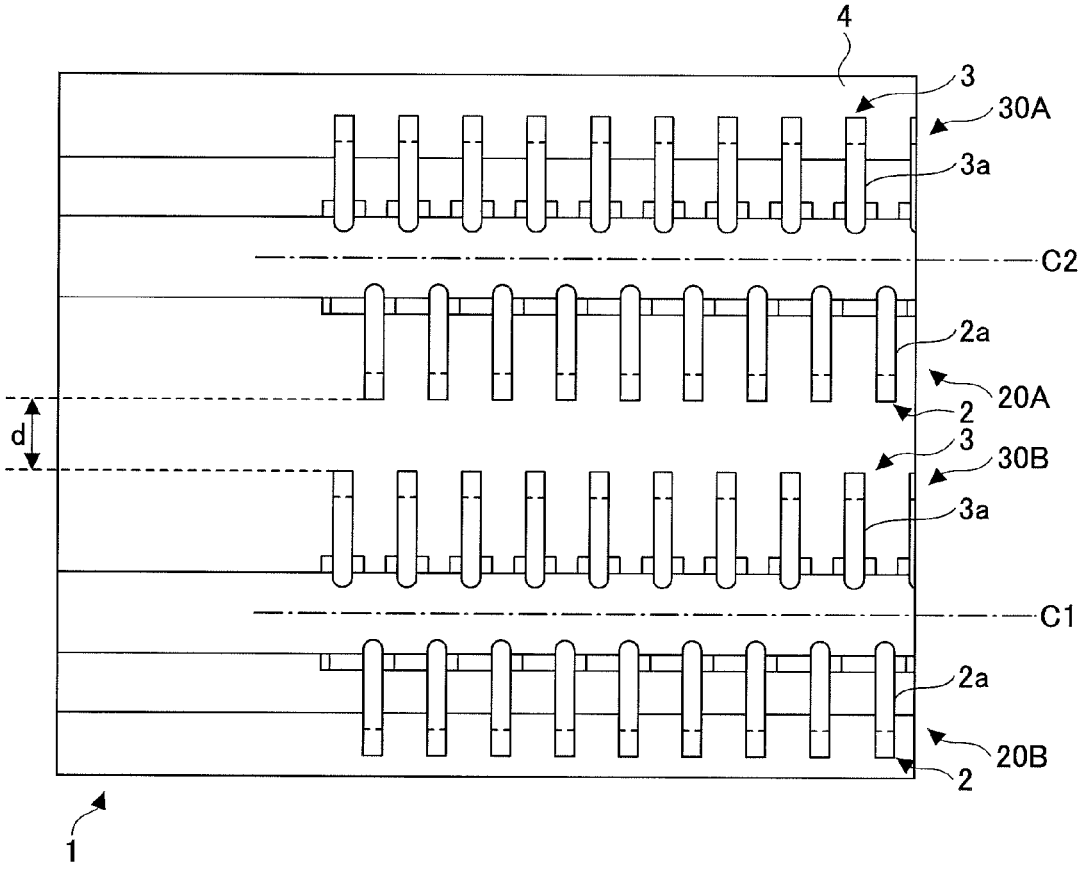
FIG. 6B is an enlarged bottom view of the connector shown in FIG. 1 when the connector is mounted on the substrate.

FIG. 6B is an enlarged bottom view of the connector 1 seen from the approaching direction S1 in FIG. 1 at the final mounting position. FIG. 6B corresponds to FIG. 6A.

By comparing FIG. 6A and FIG. 6B, the first contacting portions 2*a* of the line 20A and the line 20B slide in the first width direction W1 while the second contacting portions 3*a* of the line 30A and the line 30B slide in the second width direction W2. It means that the distance between the first contacting portions 2*a* of the line 20B and the corresponding second contacting portions 3*a* of the line 30B becomes larger at the final mounting position as shown in FIG. 6B compared with that before placing the connector 1 on the substrate 6.

Similarly, the distance between the first contacting portions 2*a* of the line 20A and the corresponding second contacting portions 3*a* of the line 30A becomes larger at the final mounting position as shown in FIG. 6B compared with that before placing the connector 1 on the substrate 6.

However, the distance between the first contacting portions 2*a* of the line 20A and the corresponding second contacting portions 3*a* of the line 30B becomes smaller at the final mounting position as shown in FIG. 6B compared with that before placing the connector 1 on the substrate 6.

The first pads and the second pads formed on the substrate 6 may have a rectangular or elliptical plan shape. Each of the first pads and the second pads formed on the substrate 6 may be positioned in a range such that the corresponding first contacting portion 2*a* of the first contact 2 or the second contacting portion 3*a* of the second contact 3 contacts the first pad or the second pad of the substrate 6 at the initial placing position before the screws 5 are fixed with the fixing members of the substrate 6 and at the final mounting position when the screws 5 are fixed with the fixing members of the substrate 6.

In this embodiment, the first contacting portion 2*a* of the first contact 2 and the second contacting portion 3*a* of the second contact 3 are positioned lower than the lower surface of the housing 4 other than the guide portions 4*c* of the housing 4 as shown in FIG. 3.

According to the connector 1 of the embodiment, the following merits can be obtained.

When mounting the connector 1 on the substrate 6, as the first contacts 2 and the second contacts 3 deflect to have the first contacting portions 2*a* and the second contacting portions 3*a* slide on or in the first pads and the second pads of the substrate 6, respectively, when the first contacting portions 2*a* of the first contacts 2 and the second contacting portions 3*a* of the second contacts 3 are pushed toward the respective first pads and the second pads of the substrate 6, the first contacts 2 and the second contacts 3 can electrically contact the respective first pads and the second pads of the substrate 6 with appropriate pushing forces.

With this, the first contacts 2 and the second contacts 3 of the connector 1 can be electrically connected to the pads of the substrate 6 without using reflowing or soldering. Therefore, according to this embodiment, even after the connector 1 is mounted on the substrate 6 and fixed with each other, the connector 1 or the substrate 6 can be repaired without heating the fixed structure for melting solder as these are connected without reflowing or soldering. It means that the connector 1 can surely be electrically connected to the substrate 6 while being capable of being repaired.

Further, when mounting the connector 1 on the substrate 6, the first contacting portions 2*a* of the first contacts 2 and the second contacting portions 3*a* of the second contacts 2 slide on the respective first pads and the second pads of the substrate 6 while being pushed by the first pads and the second pads of the substrate 6. Therefore, the first contacts 2 and the second contacts 3 can wipe the surface of the respective first pads and the second pads of the substrate 6 so that contamination on the surfaces of the first pads and the second pads such as dirt, dust, oxide layers, rust or the like can be removed. With this, the electrical connection between the connector 1 and the substrate 6 can be ensured.

Further, as the first contacting portions 2*a* of the first contacts 2 and the second contacting portions 3*a* of the second contacts 3 touch the respective pads of the substrate 6 at the initial placing position, the first contacting portions 2*a* and the second contacting portions 3*a* can smoothly slide on the respective first pads and the second pads of the substrate 6.

Further, as shown in FIG. 1, the housing 4 has open spaces in the vicinity of the first contacting portions 2*a* and the second contacting portions 3*a* for allowing sliding of the first contacting portions 2*a* and the second contacting portions 3*a*. Therefore, an insulator of the housing 4 does not exist between the first contacting portions 2*a* and the second contacting portions 3*a* of the adjacent lines.

However, according to the connector 1 of the embodiment, as the first contacting portions 2*a* of the first contacts 2 and the second contacting portions 3*a* of the second contacts facing each other before mounting the connector 1 on the substrate 6 separate from each other after the connector 1 is fixed to the substrate 6. Therefore, the interference between the electrical signals of the first contacts 2 and the second contacts 3 of the adjacent lines can be prevented so that the generation of noise can also be prevented. Thus, the reliability of the electrical connection can be improved in this point as well.

Further, according to this embodiment, as the first contacting portions 2*a* of the first contacts 2 and the second contacting portions 3*a* of the second contacts which are not initially facing each other such as the first contacting portions 2*a* of the line 20A and the second contacting portions 3*a* of the line 30B shown in FIG. 6A and FIG. 6B, the first contacting portions 2*a* are aligned to shift for ½P with respect to the second contacting portions 3*a*. Therefore, even when the first contacting portions 2*a* of the line 20A and the second contacting portions 3*a* of the line 30B become close to each other at the final mounting position as shown in FIG. 6B, the distance between the first contacting portions 2*a* and the nearest second contacting portions 3*a* becomes $(d^2+(\frac{1}{2}P)^2)^{1/2}$ (where d is the distance between the first contacting portions 2*a* and the second contacting portions 3*a* in the first width direction W1 and the second width direction W2) so that the distance can be longer. Therefore, the interference between the electrical signals of the first contacts 2 and the second contacts 3 of the adjacent lines in this case can also be prevented so that the generation of noise can also be prevented. Thus, the reliability of the electrical connection can be improved in this point as well.

Further, according to this embodiment, as it is not necessary to connect the first contacts 2 and the second contacts 3 of the connector 1 with the pads of the substrate 6 by reflowing or soldering, a space for providing soldering paste is unnecessary.

Further, as the first contacting portions 2*a* of the first contacts 2 slide in the first width direction W1 while the second contacting portions 3*a* of the second contacts 3 slide in the second width direction W2, which is the opposite to the first width direction W1, the first contacts 2 and the second contacts 3 facing each other may be placed at the center of the connector 1 in the first width direction W1 and the second width direction W2.

Further, even when the plural lines of alignment of the first contacts 2 and the second contacts 3 are aligned, the size of the alignments in the first width direction W1 and the second width direction W2 can be formed smaller.

Further, as the first contacting portions 2*a* and the second contacting portions 3*a* slide only after mounting the connector 1 on the substrate 1, the size of the connector 1 before mounting on the substrate 6 can also be formed smaller and more compact.

For example, the connector 1 may be configured such that the first contacts 2 and the second contacts 3 do not touch the respective pads of the substrate at the initial placing position provided that the first contacts 2 and the second contacts 3 contact and slide on the pads of the substrate 6 while the fixing members (not shown in the drawings) of the substrate 6 are being fixed with the respective screws 5 of the connector 1. Such a configuration could include a case where wiping of the pads is not so necessary, or where friction forces at sliding are lower, for example.

Further, the alignment of the first contacts 2 and the second contacts 3 may be arbitrary changed.

Further, although it is described that the first contacts 2 are configured to include the offset portions 2*h* in the above embodiment, the second contacts 3 may be configured to include the offset portions instead of the first contacts 2.

The embodiment relates to a connector that can be applied for a home, an office or an industrial electronic device as it is capable of being surely electrically connected to a substrate and being easily repaired.

According to the embodiment, a connector surely electrically connected to a substrate while being capable of being repaired can be provided.

Further, the connector can be formed in a small size.

The present invention is not limited to the specifically disclosed embodiments, and variations and modifications may be made without departing from the scope of the present invention.

The present application is based on Japanese Priority Application No. 2011-49650 filed on Mar. 7, 2011, the entire contents of which are hereby incorporated herein by reference.

What is claimed is:

1. A connector to be mounted on a substrate including a first pad and a second pad formed on a surface of the substrate, comprising:

a first contact including a first contacting portion to be in contact with the first pad when the connector is mounted on the substrate;

a second contact including a second contacting portion to be in contact with the second pad when the connector is mounted on the substrate, wherein the first contact and the second contact being configured such that the first contacting portion slides on the first pad in a first direction while the second contacting portion slides on the second pad in a second direction opposite to the first direction, when the first contact and the second contact are pushed toward the first pad and the second pad, respectively, while the connector is being placed on and fixed to the substrate;

a housing, wherein the first contact includes a base portion and the second contact includes a base portion, wherein the base portion of the first contact and the base portion of the second contact are held by the housing to face each other, wherein the base portion of the first contact and the base portion of the second contact are held by the housing not to slide even when the first contact and the second contact are pushed toward the first pad and the second pad, respectively, while the connector is being placed on and fixed to the substrate, wherein the first contact includes an offset portion that shifts the first contacting portion a predetermined amount from the second contacting portion in a third direction which is perpendicular to the first direction and the second direction;

a first line of alignment of plural of the first contacts aligned in the third direction with a predetermined pitch P; and a second line of alignment of plural of the second contacts aligned in the third direction with the predetermined pitch P, and wherein the offset portion of each of the first contacts shifts the first contacting portion ½P from the second contacting portion of the corresponding second contact.

2. A connector to be mounted on a substrate including a first pad and a second pad formed on a surface of the substrate, comprising:

a first contact including a first contacting portion to be in contact with the first pad when the connector is mounted on the substrate;

a second contact including a second contacting portion to be in contact with the second pad when the connector is mounted on the substrate;

a first line of alignment of plural of the first contacts; and a second line of alignment of plural of the second contacts, wherein the first contact and the second contact being configured such that the first contacting portion slides on the first pad in a first direction while the second contacting portion slides on the second pad in a second direction opposite to the first direction, when the first contact and the second contact are pushed toward the first pad and the second pad, respectively, while the connector is being placed on and fixed to the substrate, wherein first contact includes an offset portion that shifts the first contacting portion a predetermined amount from the second contacting portion in a third direction which is perpendicular to the first direction and the second direction, wherein the first line of alignment of plural of the first contacts are aligned in the third direction with a predetermined pitch P, wherein the second line of alignment of plural of the second contacts are aligned in the third direction with the predetermined pitch P, and wherein the offset portion of each of the first contacts shifts the first contacting portion less than the predetermined pitch P from the second contacting portion of the corresponding second contact.

3. The connector according to claim 2, wherein the first contact includes an elastic portion that slides the first contacting portion in the first direction when the first contact is pushed toward the first pad and the second contact includes an elastic portion that slides the second contacting portion in the second direction when the second contact is pushed toward the second pad.

4. The connector according to claim 2, further comprising:

a housing, and wherein the first contact includes a base portion and the second contact includes a base portion, the base portion of the first contact and the base portion of the second contact are held by the housing to face each other, and the first contacting portion and the second contacting portion slide to separate from each other when the first contact and the second contact are pushed toward the first pad and the second pad, respectively, while the connector is being placed on and fixed to the substrate.

5. The connector according to claim 2, wherein the first contact includes a base portion extending in an approaching direction in which the connector is moved when mounting the connector on the substrate, a curving portion extending from the end of the base portion in the first direction, an elongating portion further extending from the end of the curving portion in the approaching direction and a bent portion extending from the end of the elongating portion in the second direction, and the second contact includes a base portion extending in the approaching direction, a curving portion extending from the end of the base portion in the second direction, an elongating portion further extending from the end of the curving portion in the approaching direction and a bent portion extending from the end of the elongating portion in the first direction.

6. The connector according to claim 2, further comprising:

a fixing member to be fixed with another fixing member provided on the substrate so that the connector is fixed to the substrate.

7. A connector to be mounted on a substrate including a first pad and a second pad formed on a surface of the substrate, comprising:

a first contact including a first contacting portion to be in contact with the first pad when the connector is mounted on the substrate;

a second contact including a second contacting portion to be in contact with the second pad when the connector is mounted on the substrate, wherein the first contact and the second contact being configured such that the first contacting portion slides on the first pad in a first direction while the second contacting portion slides on the second pad in a second direction opposite to the first direction when the first contact and the second contact are pushed toward the first pad and the second pad, respectively, while the connector is being placed on and fixed to the substrate, a first line of alignment of plural of the first contacts aligned in a third direction which is perpendicular to the first direction and the second direction, with a predetermined pitch P; and a second line of alignment of plural of the second contacts aligned in the third direction with the predetermined pitch P, the second line being in a parallel relationship with the first line, and wherein the first contacting portion of each of the first contacts is shifted ½P from the second contacting portion of the corresponding second contact.

8. The connector according to claim 7, further comprising:

a third line of alignment of plural of the first contacts aligned in the third direction with the predetermined pitch P and a fourth line of alignment of plural of the second contacts aligned in the third direction with the predetermined pitch P, the third line and the fourth line being in a parallel relationship with the first line and the second line and the first line, the second line, the third line and the fourth line being aligned in the first direction or the second direction in this order.

9. The connector according to claim 7, wherein the first contact includes an elastic portion that slides the first contacting portion in the first direction when the first contact is pushed toward the first pad and the second contact includes an elastic portion that slides the second contacting portion in the second direction when the second contact is pushed toward the second pad.

10. The connector according to claim 7, further comprising:

a housing, and wherein the first contact includes a base portion and the second contact includes a base portion, the base portion of the first contact and the base portion of the second contact are held by the housing to face each other, and the first contacting portion and the second contacting portion slide to separate from each other when the first contact and the second contact are pushed toward the first pad and the second pad, respectively, while the connector is being placed on and fixed to the substrate.

11. The connector according to claim 7, wherein the first contact includes a base portion extending in an approaching direction in which the connector is moved when mounting the connector on the substrate, a curving portion extending from the end of the base portion in the first direction, an elongating portion further extending from the end of the curving portion in the approaching direction and a bent portion extending from the end of the elongating portion in the second direction, and the second contact includes a base portion extending in the approaching direction, a curving portion extending from the end of the base portion in the second direction, an elongating portion further extending from the end of the curving portion in the approaching direction and a bent portion extending from the end of the elongating portion in the first direction.

12. The connector according to claim 7, further comprising:

a fixing member to be fixed with another fixing member provided on the substrate so that the connector is fixed to the substrate.

* * * * *